United States Patent [19]

Hajianpour

[11] Patent Number: 4,538,595

[45] Date of Patent: Sep. 3, 1985

[54] PASSIVE EXERCISING DEVICE

[76] Inventor: Muhamad A. Hajianpour, 2513 S.W. 27 Ave., Miami, Fla. 33135

[21] Appl. No.: 582,081

[22] Filed: Feb. 21, 1984

[51] Int. Cl.[3] ..... A61H 1/00

[52] U.S. Cl. ..... 128/25 R; 128/25 B

[58] Field of Search ..... 128/25 B, 25 R, 80 A, 128/80 B, 80 R, 48, 49; 3/1.1, 1.2, 4, 14; 272/96

[56] References Cited

U.S. PATENT DOCUMENTS

| | | | |
|---|---|---|---|
| 3,717,144 | 2/1973 | Bimler | 128/80 A |
| 3,929,335 | 12/1975 | Malick | 128/25 R |

FOREIGN PATENT DOCUMENTS

| | | | |
|---|---|---|---|
| 2375856 | 9/1978 | France | 128/80 R |
| 0644469 | 1/1979 | Switzerland | 128/25 R |
| 0023994 | of 1910 | United Kingdom | 128/16 |

*Primary Examiner*—Richard J. Apley

*Assistant Examiner*—Kathleen D'Arrigo

*Attorney, Agent, or Firm*—John Cyril Malloy, P.A.

[57] ABSTRACT

An exercising device of the type designed to cause movements of predetermined, designated limb portions about a predetermined joint wherein first and second brace assemblies are designed to be mounted in at least partially gripping relation to limb portions on opposite sides of designated joints. A driving means including a drive motor and gear assembly drives an action arm in a substantially reciprocal path of travel so as to cause selected movement of one brace assembly relative to the other brace assembly about a predetermined joint without the patient exercising muscle control or coordination. A control assembly as well as the drive motor and gear assembly are housed as a contained unit and removably mounted on one of the brace assemblies in such a manner as to be movable therewith so as to allow ambulatory movement of the patient during the exercising period.

27 Claims, 45 Drawing Figures

PASSIVE EXERCISING DEVICE

BACKGROUND OF THE INVENTION

1. Field of the Invention

This invention is related to a passive exercising device of the type specifically structured to cause movement of certain limb portions about predetermined body joints such as the wrist, elbow, ankle, etc. without requiring muscle control or coordination of the patient wherein such movement is intended to aid in the healing of the joint and surrounding tissues where trauma has occurred.

2. Description of the Prior Art

The producing of passive motion in and about injured joints on a patient's body has been a matter of interest for some thirty-five years. Recently, the presentation of experimental work and data by those in the medical profession has increased the academic interest both in the United States and abroad. Over the past three to four years, many medical and otherwise related papers or publications have been introduced relating to experimental work on animals as well as studies on human subjects discussing in some detail the benefits of continuous passive motion of a fractured or traumatized joint. Through such publications evidence has been produced that indicates such passive exercising is beneficial to the overall healing of the joint whether such trauma was the result of an accident or of surgical intervention.

It is now a popular and widely held belief by many surgeons that passive motion induced to an injured joint promotes the healing, shortens the recovery time and results in better range of motion at the end of the treatment period.

In order to accomplish such passive exercising, numerous types of machines and devices have been developed which are considered to be both experimental and presently available for commercial application. These prior art devices are designed and structured for the application of passive motion to joints including the wrists, elbow, knee, ankle, etc. Such existing prior art devices are disclosed in the following U.S. Pat. Nos. 3,323,518; 3,976,057; 2,832,334; 2,924,214; and 3,683,897.

While exercising devices of the type described above and disclosed in the aforementioned United States patents are applicable and certainly operative for the intended and designed function, it is still recogized that there is a need in the medical profession for a device capable of efficiently and effectively producing preselected and controlled movement about a joint wherein the degree of movement can be accurately controlled. Further, such a preferred device should be effectively self-contained as a single unit wherein the control means, drive motor and gear assembly, as well as any activating structure, should be designed and disposed for mounting such that the entire exercising device can be ambulatory with the patient if so desired.

SUMMARY OF THE INVENTION

The present invention is directed towards a passive exercising device specifically designed to move one limb portion about a predetermined joint on a patient's body relative to another limb portion without utilizing muscle control or coordination of the patient. It is believed that such movement, done repeatedly as an exercise, enhances healing and increases the range of movement of the traumatized joint once the healing period is completed. It is therefore an object of the present invention to accomplish return of normal movement, or movement as near normal as possible, to a traumatized joint, once the healing period has been completed.

The subject exercising device comprises a brace means including a first brace assembly and a second brace assembly both of which are configured to at least partially surround and in some embodiments grippingly embrace designated limb portions on the patient's body. The brace assemblies are disposed in spaced apart relation to one another on opposite sides of the joint in which movement is to be induced. Such joints may include but are not limited to wrist, elbow, ankle, and knee joints wherein the limb portions on opposite sides of these joints are engaged by the first and second brace assemblies as set forth above.

The subject device further comprises a drive means in the form of a drive motor electrically powered and secured to a casing means. The casing means is structured and dimensioned to further support a gear assembly in driven relation to the drive motor wherein the gear assembly comprises one or more reduction gear elements which when interconnected to the output of the drive motor, serve to drive a drive shaft at a predetermined reduced R.P.M. Further, the gear assembly and drive motor are arranged relative to one another so as to be mounted on the casing means essentially as a self-contained unit wherein the entire casing means supporting such unit is removably mounted on one of the brace assemblies so as to move therewith. This particular structure allows the patient to be ambulatory while operation of the exercising device and the exercising cylce is being conducted.

Activation means in the form of an action arm is provided wherein the action arm is interconnected in driven relation by the gear means through interconnection with the drive motor and further wherein the action arm extends from the first brace assembly on which the casing means is mounted into driving relation to the second brace assembly. In certain embodiments of the present invention, which will be explained in greater detail hereinafter, the action arm physically extends across the space separating the first an second brace assembly and also extends across the predetermined joint being exercised. Further, the disposition, structure and configuration of the action arm is such as to be driven in a substantially reciprocal path of travel and is substantially parallel to the casing means and to the gear assembly and drive motor mounted thereon. By virtue of this structure, the casing means and action arm are generally disposed laterally of the predetemined joint and associated limb portions which are to be exercised. This enhances the ability to both control the range of movement of one limb portion about the predetermined joint as well as to force movement of the limb portion along its substantially "normal" path of travel such limb portion would assume if not secured to the subject exercising device.

When the drive motor is activated, the gear assembly forces the action arm to move along its reciprocal path of travel at a predetermined rate thereby in turn forcing a repeated extension and retraction type movement of one limb portion relative to a second limb portion wherein the two referred to limb portions are disposed on opposite sides and immediately adjacent to a predetermined joint.

Actuation and operation of the drive means, primarily including the drive motor, is accomplished by the provision of a control means in the form of electronic circuitry electrically interconnected to the drive motor so as to cause its activation and repeated operation in reversed or opposite directions. This is accomplished through the provision of a switching assembly which may include individual limit switches interconnected to a sensor means. Individual switch elements are activated to determine the extremes of the range of movement of the limb portion being forced between an extended and retracted position. These individual switch elements are activated and the sensor means is structured and disposed to cause activation of the circuitry which will reverse travel of the drive motor once the extremes or limits of this range of movement have been reached. While the control means is herein represented as circuitry including a switching assembly, it should be noted that the control function as hereinafter set forth could be accomplished through use of micro-processor means.

A housing means is dimensioned and structured to at least partially enclose the casing means including the outward extension of the drive motor as well as the entire gear assembly. Apertures are provided to allow extension of the action arm outwardly from the casing means through a lateral or end portion of the housing means so as to accomplish its driving interconnection with the second brace assembly. The housing means further includes an exposed control panel which provides access to the switching assembly so as to allow activation of the individual switches thereon. A plurality of illumination devices are provided and observable through an access window located on the operating panel of the housing means wherein the illumination means may include individual light emitting diode (LED) devices associated with each of the switch elements. When two of the switch elements are activated to indicate the opposite extreme range of movement of the path of travel of the action arm, and accordingly the limb portion being moved, corresponding LED's are illuminated so as to provide proper indication of the predetermined range of movement of the exercised limb portion to an operator of the device. Other indication means are associated directly with the movement of the action arm and are also observable through an auxiliary indicator window or like structure mounted on the operating panel of the housing means.

The invention accordingly comprises the features of construction, combination of elements, and arrngement of parts that will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with he accompanying drawings, in which.

Like reference numerals refer to like parts throughout the several views of the drawings.

DETAILED DESCRIPTION OF THE PREFERRED EMBODIMENT

Figure 1:
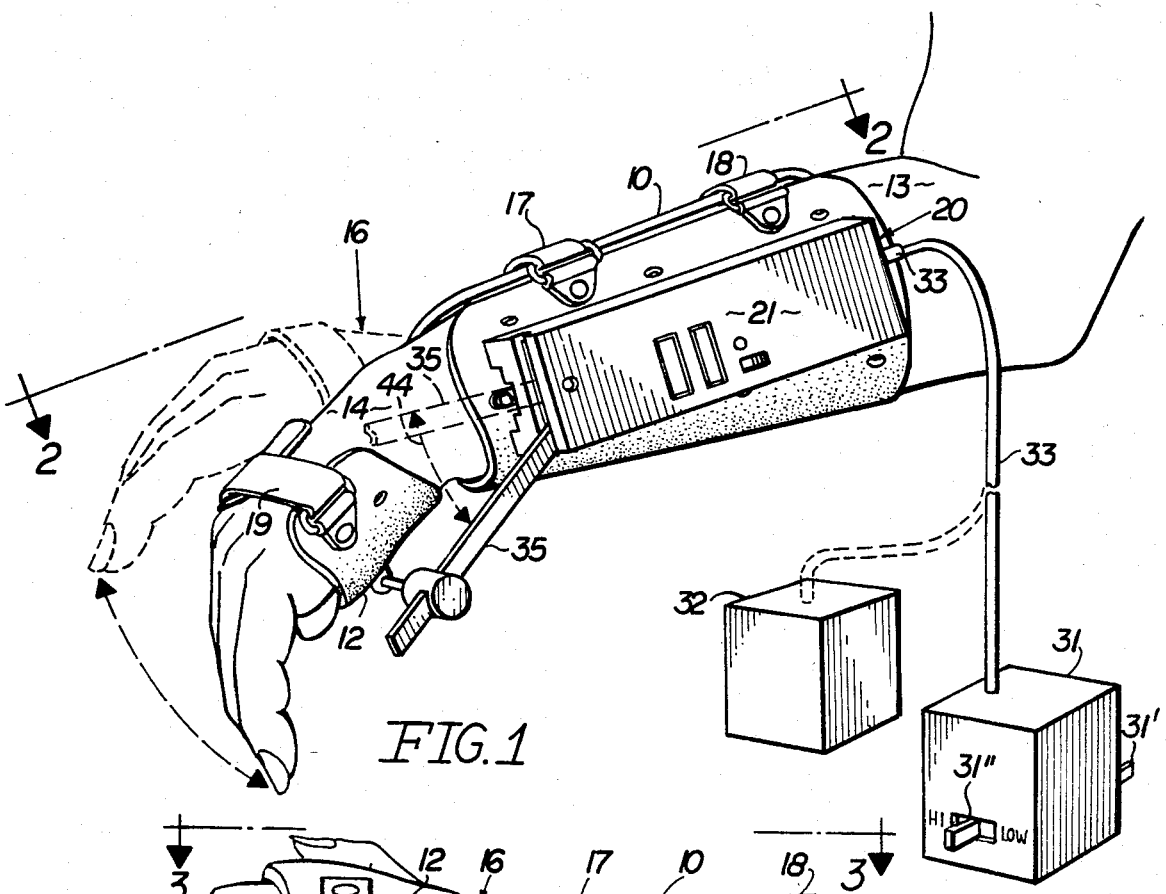
FIG. 1 is an isometric view of one preferred embodiment of the present exercising device mounted about a wrist joint.
Figure 2:
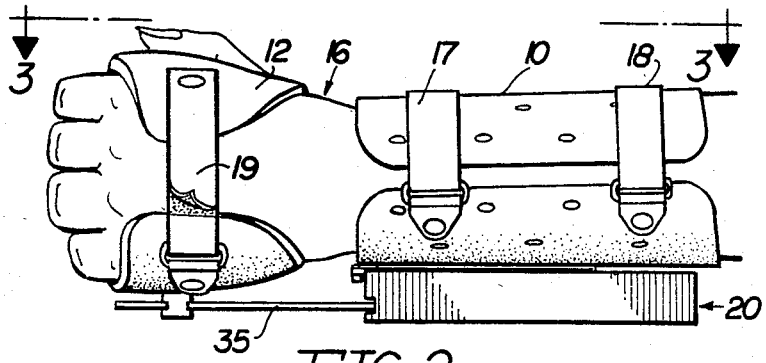
FIG. 2 is a top plan view along line 2—2 of FIG. 1.
Figure 3:
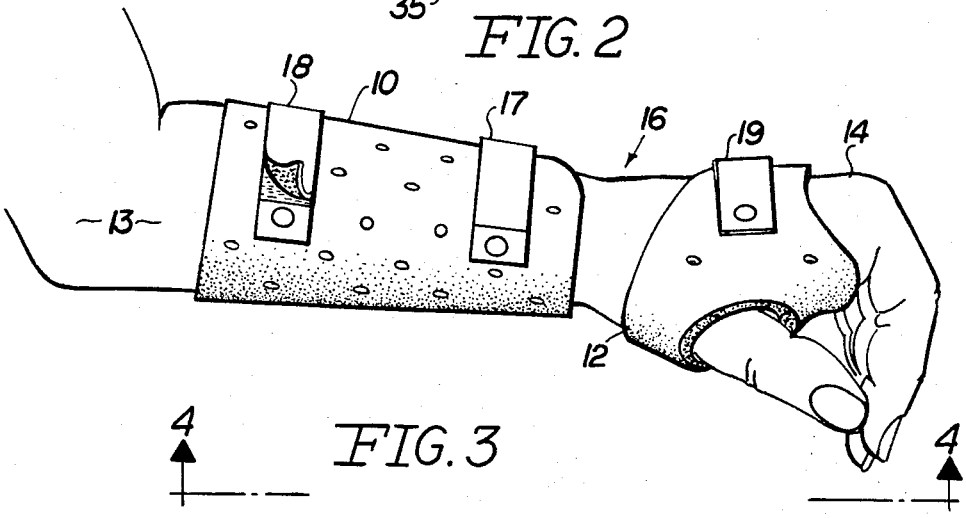
FIG. 3 is a side view along line 3—3 of FIG. 2.

One preferred embodiment of the present invention is shown in FIGS. 1 through 7 and comprises brace means including a first brace assembly 10 and a second brace assembly 12 wherein each are specifically structured to at least partially surround and firmly grip oppositely disposed limb portions such as the forearm 13 and hand portion 14 on opposite sides of the predetermined wrist joint generally indicated as 16. The first brace assembly has a plurality of connector elements 17 and 18 serving to interconnect portions of the first brace assembly 10 so as to mount it firmly about the forearm 13. Similarly, a connecting assembly 19 serves to interconnect the second brace assembly 12 in gripping relation about the hand portion 14 wherein both the first and second brace assemblies are spaced apart but located substantially adjacent to the wrist joint 14.

A housing means generally indicated as 20 includes a front exposed operating panel 21 which will be explained in greater detail hereinafter with specific reference to FIGS. 32 and 36 through 41. However, the housing means is specifically configured and dimensioned to enclose a drive means in the form of a casing means generally indicated as 24 (see FIGS. 28 and 29) wherein the casing means has mounted thereon a gear assembly including a plurality of gear elements 25 interconnected to a power takeoff shaft 26 of drive motor generally indicated as 27. In the embodiment shown in FIGS. 28 and 29 the power takeoff shaft 26 is in the form of a worm gear matingly engaging the first gear element 25' of the gear assembly. The plurality of gears may assume a number of different configurations but are provided in direct driven interconnection with the power takeoff 26 so as to provide a reduced rotational drive to the shaft 29.

An important feature of the present invention is the provision of the drive motor 27 in substantially aligned, coplanar relation to the array of plurality of gear elements 25 of the gear assembly. This allows a compact "packaging" of the drive means especially when the entire gear assembly, casing means 24 and drive motor 27 are housed within the housing means 20. Accordingly, the entire drive means including the gear assembly and drive motor 27 can be housed as a contained unit and mounted on the first brace assembly 10 (FIGS. 1 and 2) such that the patient can effectively be ambulatory during exercising of the predetermined wrist joint 16.

A power supply in the form of either a conventional a.c. source through transformer 31 or d.c. power source 32, such as a 12 volt battery, is interconnected by conductor casing 33 housing connecting wires 33' which in turn are interconnected to the drive motor 27.

Figure 29:
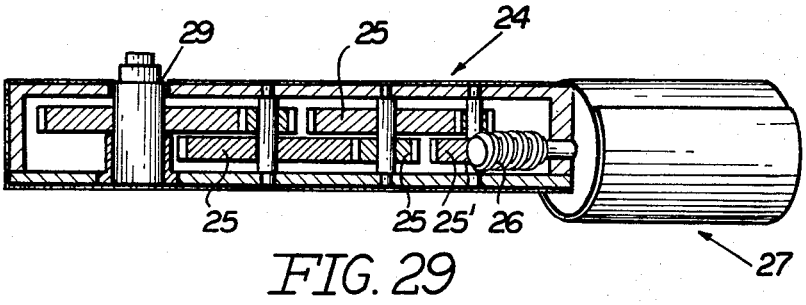
FIG. 29 is a sectional view along line 29—29 of FIG. 28.
Figure 30:
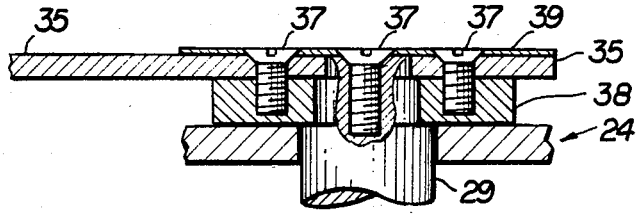
FIG. 30 is a detailed view in partial cutaway of the interconnection of an action arm to the drive shaft of the gear assembly.
Figure 31:
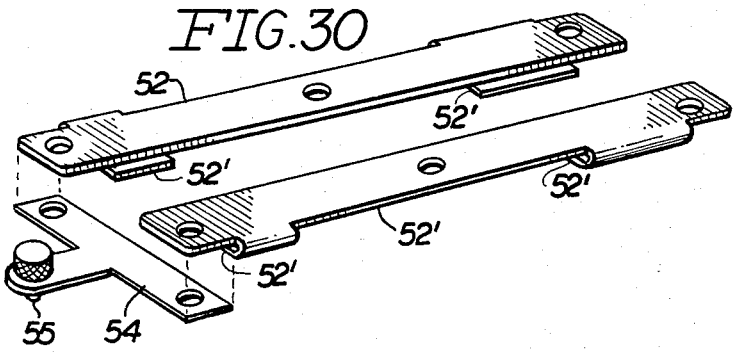
FIG. 31 is an isometric view of structural components of the mounting means for securing the housing and casing means to the brace means.
Figure 32:
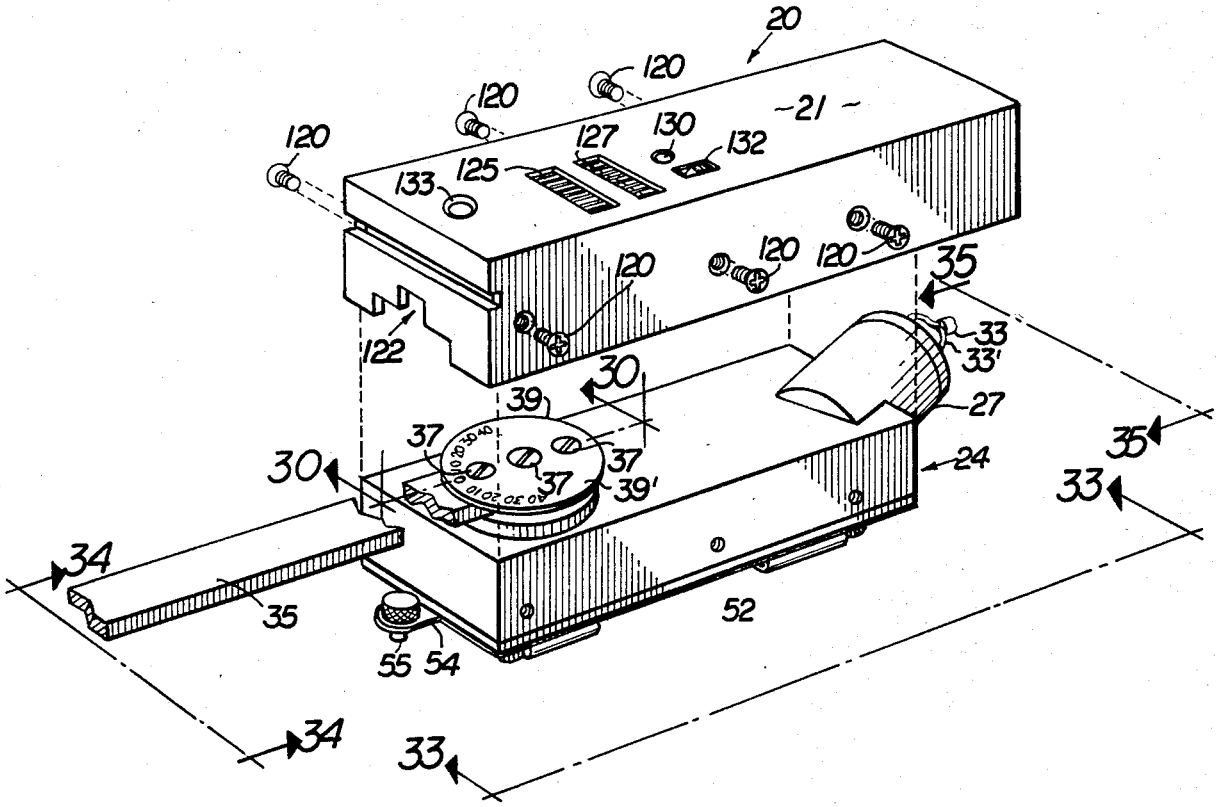
FIG. 32 is an isometric view in at least partially exploded form of the housing means structured and configured to fit over the casing means and outwardly extended drive motor of the drive assembly and in cooperative relation to the associated action arm.
Figure 33:
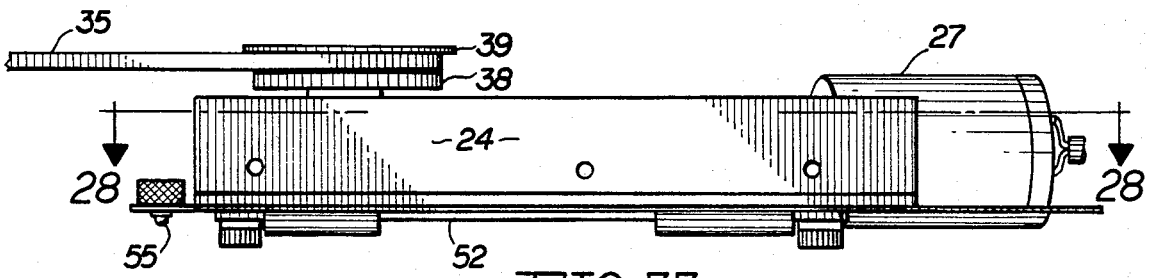
FIG. 33 is a side view along line 33—33 of FIG. 32.
Figure 34:
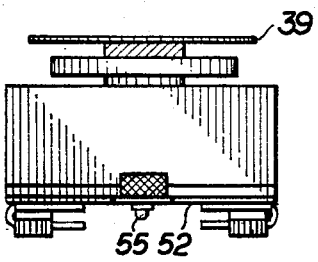
FIG. 34 is an end view along line 34—34 of FIG. 32.
Figure 35:
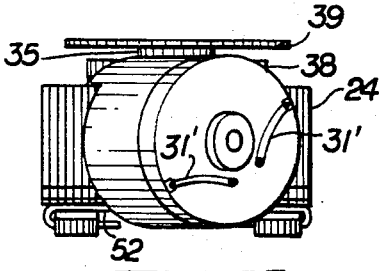
FIG. 35 is an end view along line 35—35 of FIG. 32.

Other important structural features of the preferred embodiments of the present invention comprises an actuating means in the form of an action arm means 35 attached in driven relation at one end to drive shaft 29 as it extends outwardly from the casing means 24 perpendicular to the array or plurality of gear elements 25 (see FIGS. 29 and 30). The action arm 35 is interconnected by a plurality of connector elements 37 and separated from the casing means 24 by a spacer bushing 38. An indicator plate 39, to be explained in greater detail hereinafter and as best represented in FIGS. 32 and 33, is provided to allow clear indication to the operator of the device as to the range of movement of the arm 35 as it travels along its path of travel.

Figure 28:
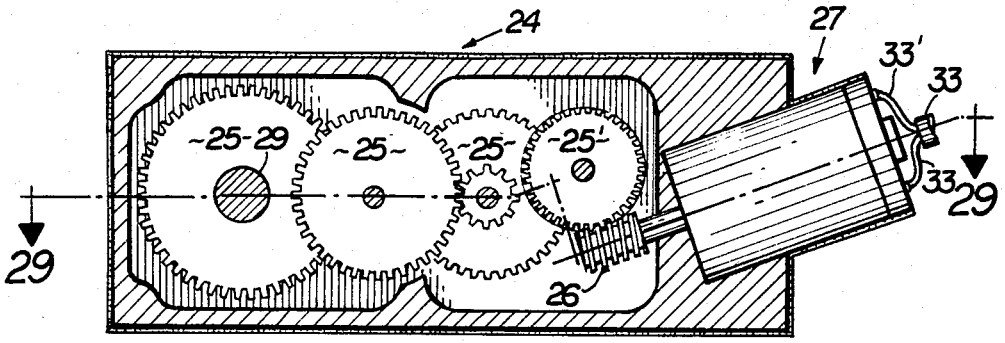
FIG. 28 is a sectional view along line 28–28 of FIG. 33 showing details of the drive means including the gear assembly in driven connection with a drive motor and mounted on a casing means.

In operation, the power source provides electrical energy to the drive motor 27 by means of the transformer 31 attached to an a.c. outlet by plug means 31' after activation of a high-low current switch 31". Alternately the power is supplied through d.c. power source 32. Upon activation, the drive motor is controlled by a control means in the form of electronic circuitry (see FIG. 45) which is representative of control circuitry to regulate both the activation and directional operation of the drive motor through inclusion of a sensor means all of which will be explained in greater detail hereinafter. Upon activatioin, the drive motor 27 serves to drive the plurality of gear elements 25 so as to provide reversible rotatable motion to the drive shaft 29 (FIGS. 28 and 29). The action arm means 35 thereby travels along a path of travel which is substantially parallel to the overall array and length of the housing means 20 and casing means 24 as well as the outward extension of the drive motor 27.

Figure 4:
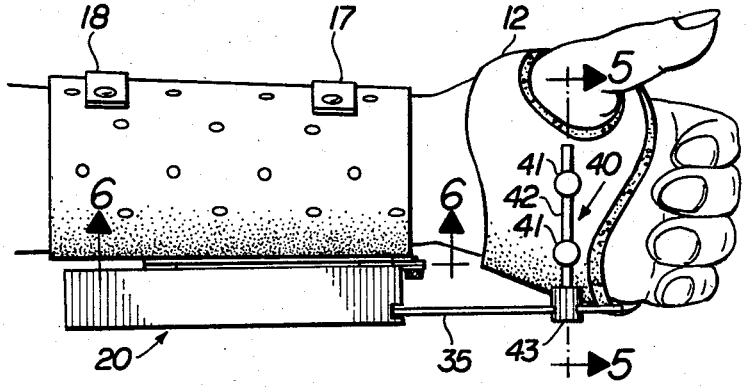
FIG. 4 is a bottom view along line 4—4 of FIG. 3.
Figure 5:
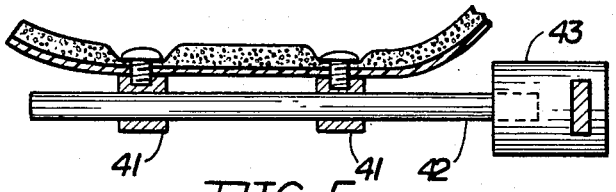
FIG. 5 is a sectional view in partial cutaway along line 5—5 of FIG. 4.

With reference to FIGS. 4 and 5, the action arm means 35 is interconnected adjacent its distal end to an attachment means generally indicated as 40. The attachment means comprises receiving means including receiving fingers 41 being centrally apertured so as to allow a rotational and sliding movement of elongated finger 42 therein. The attachment means further comprises a head portion 43 which is fixedly attached to one end of finger 42 (FIG. 5) and slidingly engages the action arm 35 so as to travel along a distal end thereof during the reciprocal travel of the action arm 35 along its intended path of travel as indicated by directional arrow 44 (see FIG. 1). Utilizing the embodiment of FIGS. 1 through 5, the wrist joint is caused to flex dorsally and vollary wherein the angle of flextion or extension or palmer flextion or dorsal flextion is determined according to the need of each individual patient and controlled by the control means in the form of the electronic circuitry (see FIG. 45). The range of motion is generally between 0 to plus 50 degrees and minus 50 degrees but is specifically not limited to this range.

Figure 6:
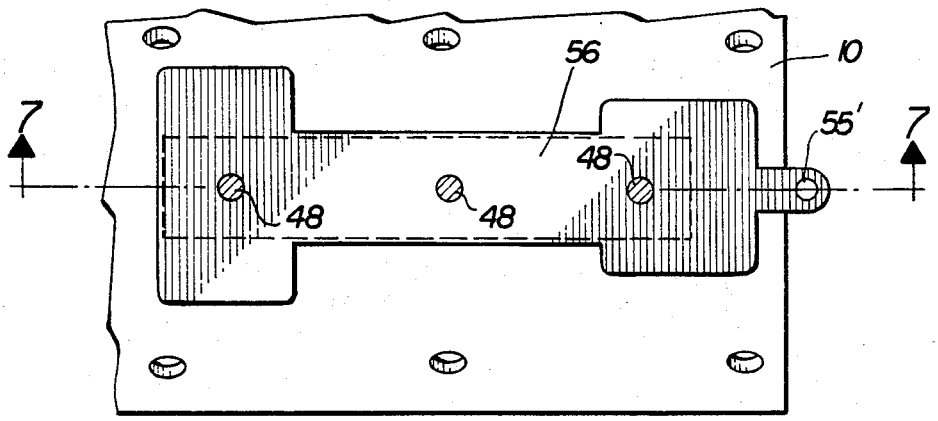
FIG. 6 is a bottom view along line 6—6 of FIG. 4 representing structural details of a mounting assembly for removably securing the housing means to the brace means.
Figure 7:
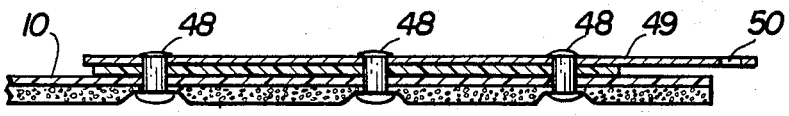
FIG. 7 is a sectional view along line 7—7 of FIG. 6.
Figure 8:
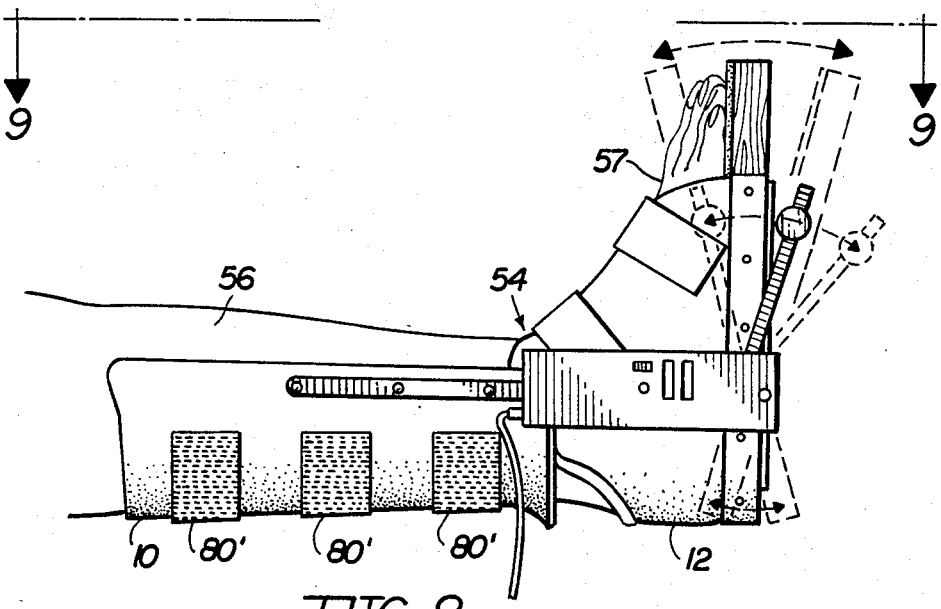
FIG. 8 is a side view of another preferred embodiment of the present invention associated with the ankle joint.

With reference to FIGS. 6 and 7, the first brace assembly 10 has fixedly attached to a lateral portion thereof, as at 48, a mounting bracket 49 which is made from a substantially flexible material and includes a connecting aperture 50 designed to be secured to a cooperating mounting bracket (see FIG. 13) including spaced apart side bars 52. Bars 52 are secured to the undersurface of the casing means (see FIG. 38) and include mounting hooks 52' designed to slide on and off bracket 49. Connector elements 53 interconnect cross bar 54 such that a spring mounted finger 55 is disposed in registry and in fact "snap fits" into the mounting aperture 55' in the bracket base 56 as shown in FIGS. 6 and 7. This allows the casing means and enclosing housing means 24 and 20 respectively to be removably attached to the first brace assembly 10 so as to move with the first brace assembly. When a d.c. power source is utilized as at 32, the entire exercising device can be ambulatory with the patient during the exercising cycle if such is desired. Further, in each of the embodiments of the present invention, similar structure is utilized to attach the casing means and housing means to one of the two brace assemblies as will be generally represented hereinafter.

Figure 9:
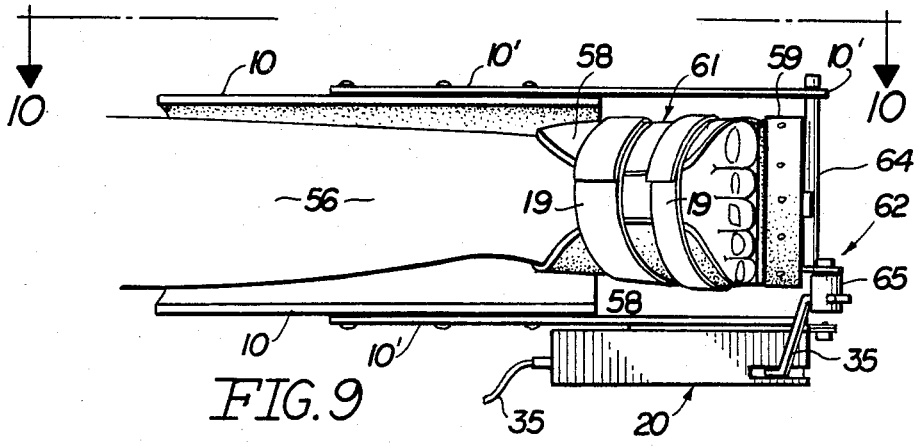
FIG. 9 is a top view along line 9—9 of FIG. 8.
Figure 10:
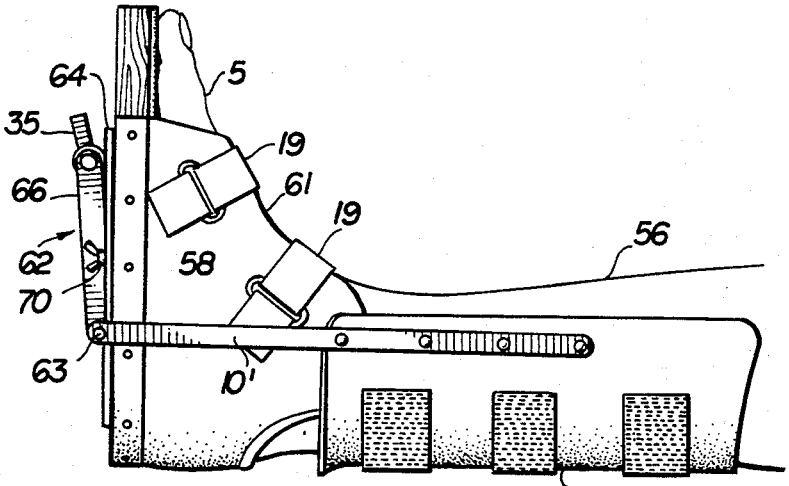
FIG. 10 is a side view along line 10—10 of FIG. 9.
Figure 11:
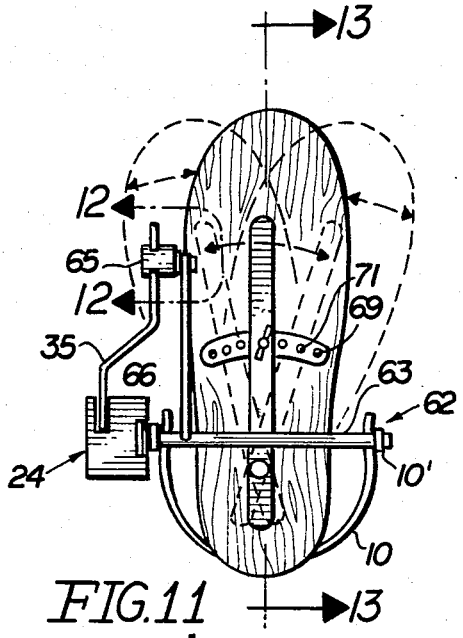
FIG. 11 is an end view showing the undersurface of a support platform of a second brace assembly of the embodiment of FIG. 8.
Figure 12:
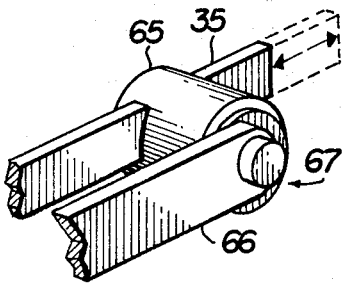
FIG. 12 is a detail view in partial cutaway of an attachment means along line 12—12 of FIG. 11.
Figure 13:
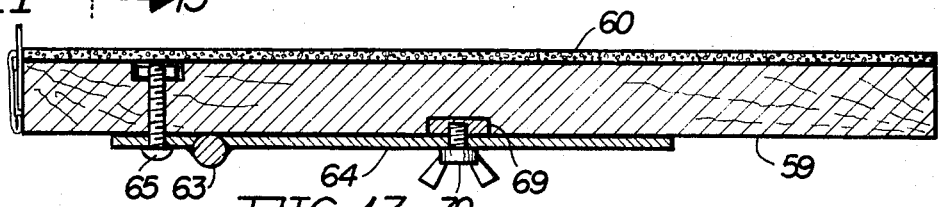
FIG. 13 is a sectional view along line 13—13 of FIG. 11.
Figure 14:
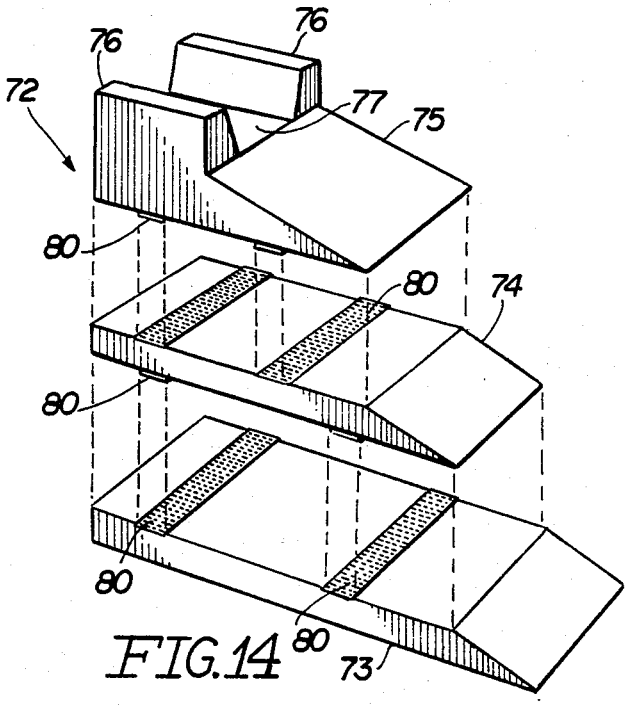
FIG. 14 is an exploded isometric view of a leg supporting assembly.
Figure 15:
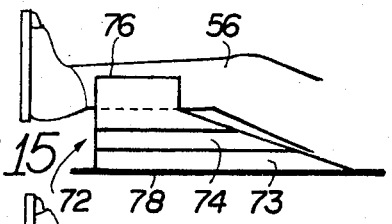
FIGS. 15, 16 and 17 are side views presented in schematic form showing support of a lower leg portion with the excersizing device attached thereto arranged at different levels through selective modification of the leg support means of FIG. 14.
Figure 16:
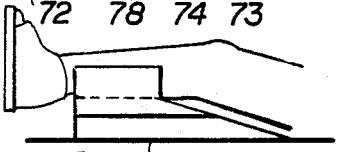
Figure 17:
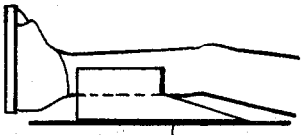

Another preferred embodiment of the present invention is shown in FIGS. 8 through 13 and includes the exercising device of the present invention being applied to the ankle joint wherein first brace assembly 10 and second brace assembly 12 are specifically configured and structured so as to at least partially embrace adjacently positioned limb portions relative to the ankle joint 54. Such limb portions include the lower leg 56 and foot 57 as shown. More specifically, first brace assembly 10 includes a trough like configuration designed to house the undersurface or be placed in surrounding relation to the calf portion of the lower leg 56 as best shown in FIG. 9. The second brace assembly 12 is in the form of a boot like structure 55 having a surrounding panel interconnected by connecting means 19 similar to that relative to the embodiment of FIG. 1. The surrounding panels 58 are provided to securely grip the foot portion 57 such that the foot portion moves therewith in a designated fashion. The boot structure 61 further includes a rear support panel 59 having a cushioning mat as at 60 (FIG. 13). A pair of auxiliary brace elements 10' are interconnected on opposite sides of the first brace assembly 10 and extend into interconnection at least in part with the attachment means generally indicated as 62. The attachment means includes an anchor element 63 fixedly secured to an upstanding tongue element 64 and secured to the undersurface of the support platform 59 by a connector element 65.

The housing means generally indicated as 20 has the action arm means 35 extending outwardly from its driven connection with the casing means (see FIG. 30) to its attached driving relation with the remainder of the attachment means generally indicated as 62. Head portion 65 is rotatably mounted on the upwardly extending finger element 66 as at 67 and slidably mounted relative to a predetermined length of the action arm means 35 as best shown in FIG. 12.

Figure 45:
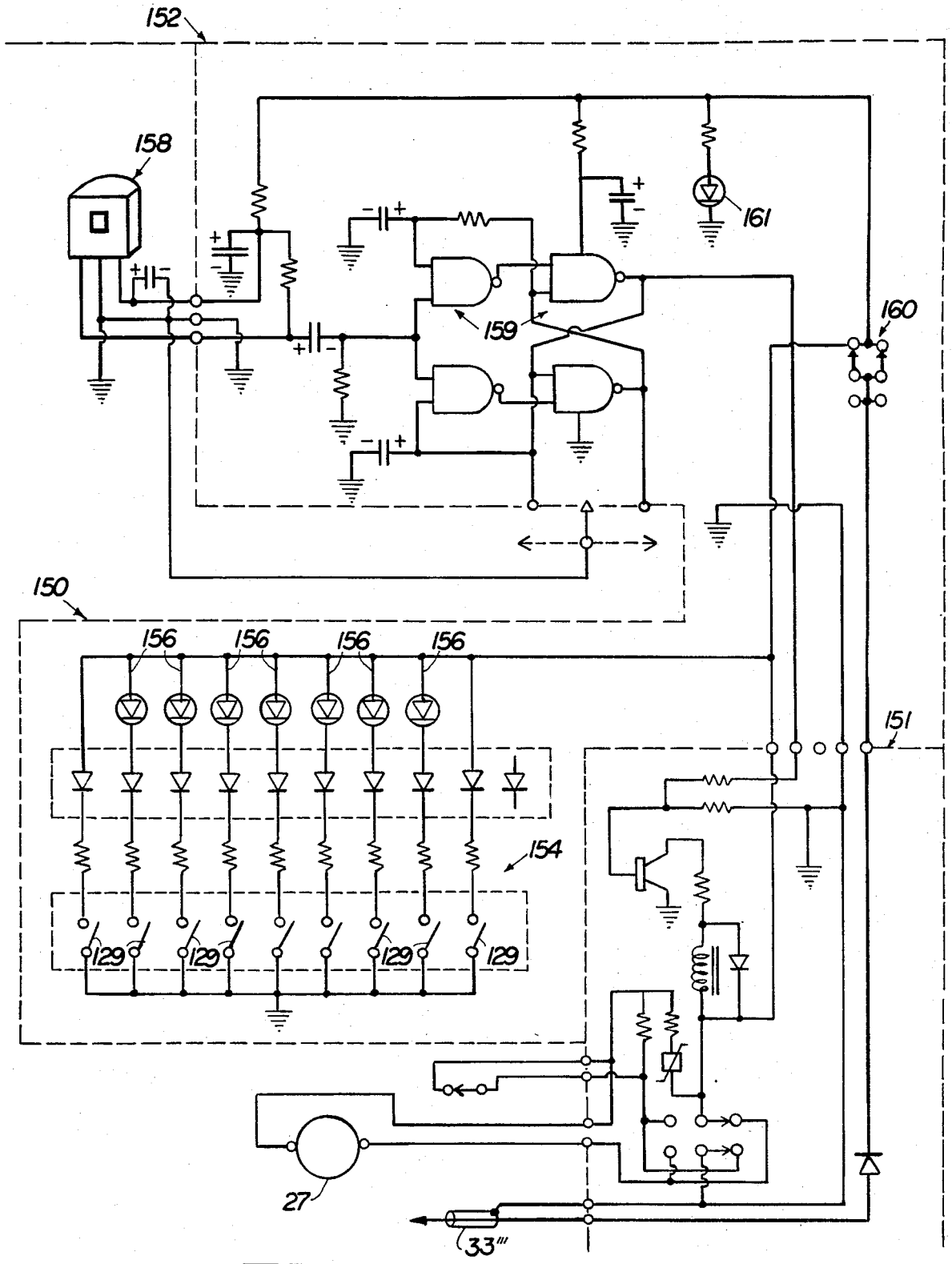
FIG. 45 is a schematic representation of control circuitry of the present invention.

Accordingly, upon activation of the drive motor 27, the action arm means 35 is forced to travel in its reciprocal fashion through a predetermined range of movement. Such travel causes travel of the upstanding finger links 66 and also movement of the anchor element 63. The fixed interconnection between tongue 64 and the anchor element 63 causes the foot to sorsi flex and planter flex wherein the range of movement generally varies from zero as a neutral or starting point to a plus 20 degree dorsal flextion and a minus 40 degree planter flextion. It should be apparent that movement can of course differ merely by controlling the control circuitry as best shown in FIG. 45.

Further with reference to FIG. 11, an adjustment means is provided to vary the radial position of the foot relative to the longitudinal axis of the lower leg portion 56. An adjustment member 69 is affixed to the undersurface of support platform 59 and has a substantially arcuate configuration and is disposed transverse to the longitudinal axis of the tongue element 64. A connector 70 may pass through the tongue element 64 into fixed interconnection with any of a plurality of connecting apertures 71 disposed in spaced apart relation to one another along the length of the member 69. Accordingy, the tongue element 64 can be repositioned along any point on the length of the member 69 so as to radially adjust and maintain the position of the foot relative to the longitudinal axis of the lower leg portion 56 as represented in broken lines in FIG. 11. The extension and flextion of the foot is then conducted at this radially maintained angle thereby adding versatility to the overall structure.

With reference to FIGS. 14, 15, 16 and 17, further structural features of the present invention comprises a leg supporting assembly generally indicated as 72 including a layered construction comprising base 73, intermediate layer 74 and top cradle member 75. The cradle member has upwardly extending legs 76 so as to form a centrally located trough as at 77 in which the undersurface of the first brace assembly 10 is configured to fit (see FIGS. 15, 16 and 17). In order to regulate the height at which the leg 56 is supported relative to a supporting base 78, one or both of the elements 73 and 74 may be removed from supporting engagement relative to the upper element 75 as shown. In order to accomplish interconnection between the individual elements, connector strips 80 may be provided in aligned relation to one another and may be made from a typical hook and loop type fastener material commonly known as Velcro. Similarly, and with reference to FIG. 8, these attachment strips 80' may be connected to the undersurface on the exterior of the first brace assembly 10 so as to secure engagement between the first brace assembly 10 and the leg supporting assembly 72 as shown in FIGS. 14 through 17.

Yet another embodiment of the present invention is shown in FIGS. 18 through 27 wherein the exercising device of the present invention is intended to induce movement to an elbow joint generally indicated as 80 and wherein a first brace assembly 82 is configured for surrounding and gripping engagement about an upper arm portion 83 and a second brace assembly generally indicated as 84 is structured for gripping and surrounding engagement about a lower arm portion 85 as well as a portion of the hand 86. The second brace assembly 84 is configured to embrace both the lower arm 85 and the hand 86 so as to stabilize the relative position between the hand and the lower arm when the lower arm is moved about the elbow joint 80 relative to the upper arm 83. In this embodiment the range of intended movement varies from substantially zero degrees at full extension to 120 degrees when retracted. It should be noted that in this embodiment as with the previous embodiments, the individual range of movement is all within a "normal" range.

Figure 18:
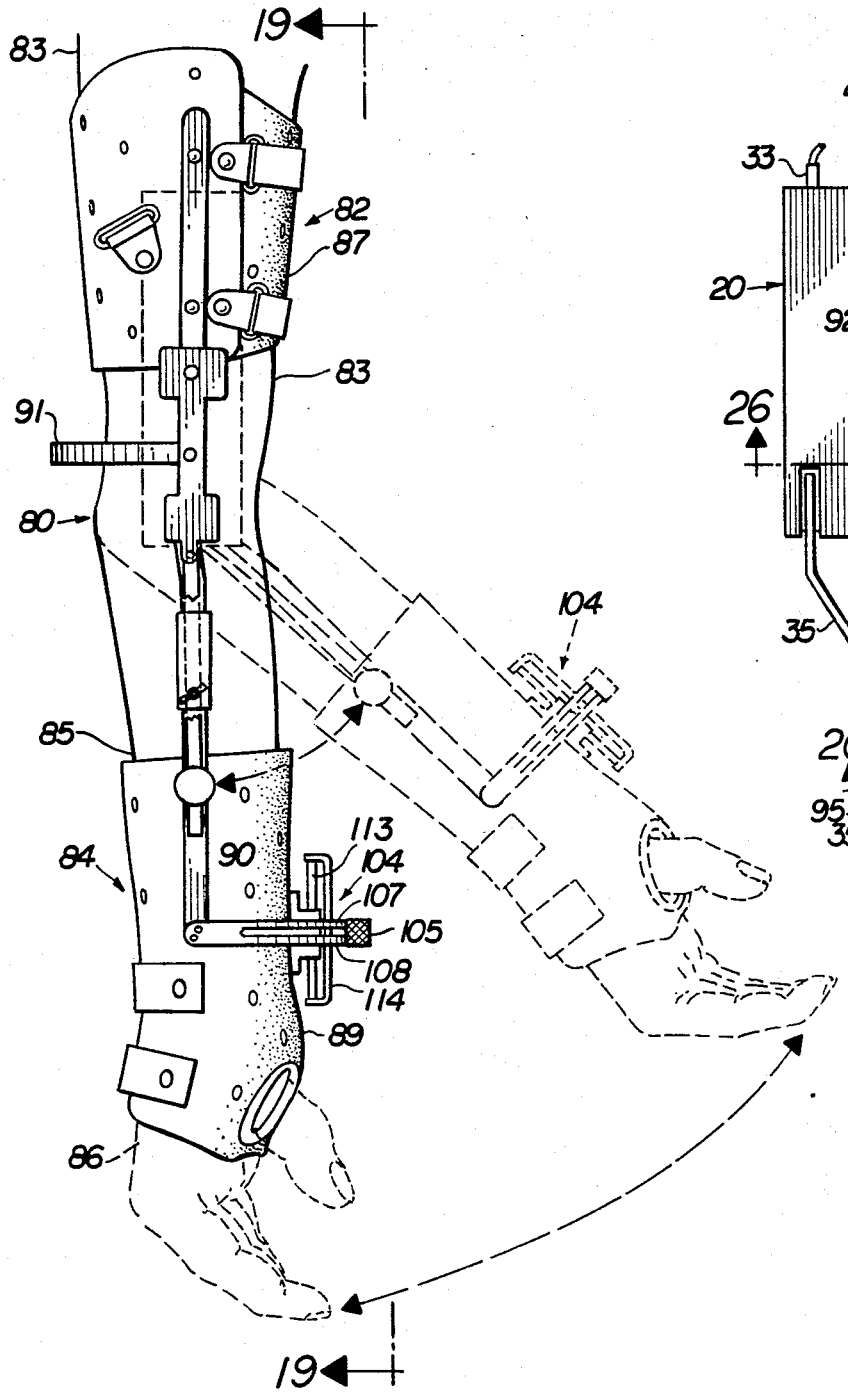
FIG. 18 is a side view of yet another preferred embodiment of the present invention with movement of a limb portion about the elbow joint indicated in broken lines.
Figure 19:
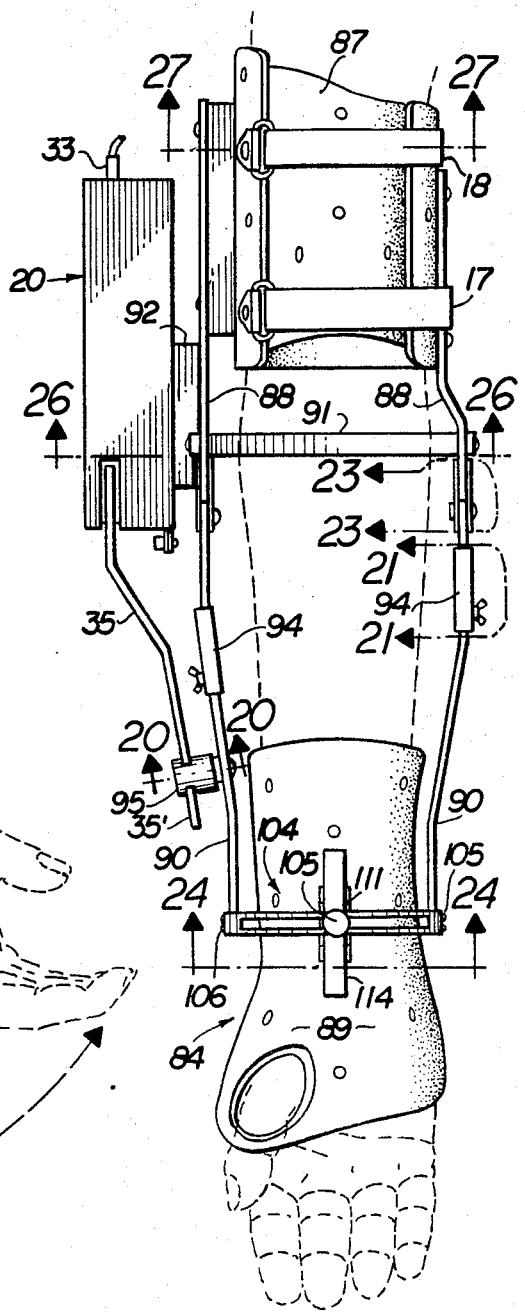
FIG. 19 is a top view along line 19—19 of FIG. 18.
Figure 20:
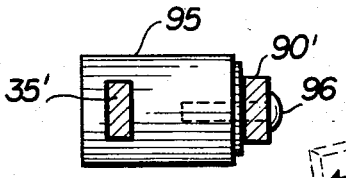
FIG. 20 is a sectional view along line 20—20 of FIG. 19 representing the attachment means of the embodiment of FIG. 19.
Figure 21:
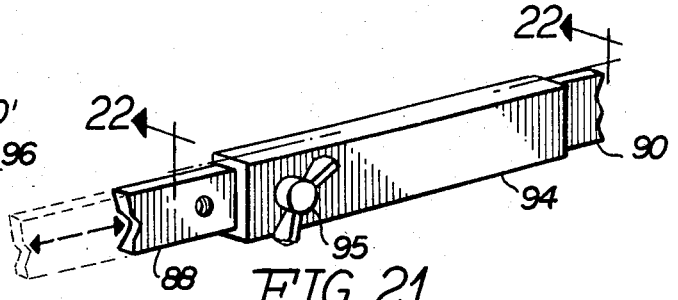
FIG. 21 is a detailed view in partial cutaway along line 21—21 of FIG. 19.
Figure 22:
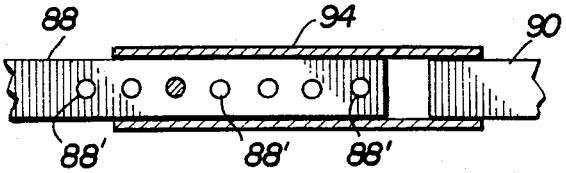
FIG. 22 is a sectional view along line 22—22 of FIG. 21.

In accomplishing such movement, the first brace assembly 82 comprises a first primary brace 87 and a first auxiliary brace including elongated brace elements 88 fixed to each side of the primary brace 87 and extending outwardly therefrom. Similarly, the second brace assembly 84 comprises a second primary base 89 and a second auxiliary brace including two outwardly extending brace elements 90. A surrounding support cuff 91 is secured in interconnected relation to the first auxiliary brace element 88 as shown in FIG. 18 and the housing means 20 including the casing means, drive means and drive motor mounted thereon is mounted laterally of the first brace assembly 82 on one of the auxiliay brace elements 88 by virtue of a spacer type connection 92 which may be affixed in cooperative relation to the mounting means 52, 54 as described above. As with the above-referred to embodiments, connecting elements 17 and 18 are provided so as to hold the first brace assembly 82 in surrounding, gripping relation to the upper arm portion 83 as shown. Adjustment means 94 are provided in interconnecting relation between the first auxiliary brace elements 88 and the second auxiliary brace elements 90 and are shown in detail in FIGS. 21 and 22. In such structure, the element 90 is fixedly secured to the surrounding sleeve 94 wherein element 88 is movably or slidably mounted therein and includes a plurality of mounting apertures 88'. Any of these apertures can fit into registry with a protruding connector element 95 such that the position of the auxiliary brace elements 88 may be fixed relative to the sleeve 94 and the second auxiliary braces 90. By virtue of this structure, the space between the first brace assembly 82 and the second brace assembly 84 and the collective longitudinal length of the respective first and second auxiliary brace elements 88 and 90 may be varied in order to compensate for the difference in overall length of a patient's arm which may vary greatly between adults and children, men and women, etc. In order to cause the extension and retraction of the lower arm 85 and effectively coupled hand 86 surrounded by secondary brace assembly 84, the drive motor 27 is actuated causing the action arm means 35 to move along its designated path of travel. The attachment means of this invention includes head portion 95 (see FIG. 20) slidingly engaging and traveling along the distal end 35' of the action arm means 35 and also rotatably attached to the second auxiliary brace 90 as at 90' through supporting connector 96.

Figure 23:
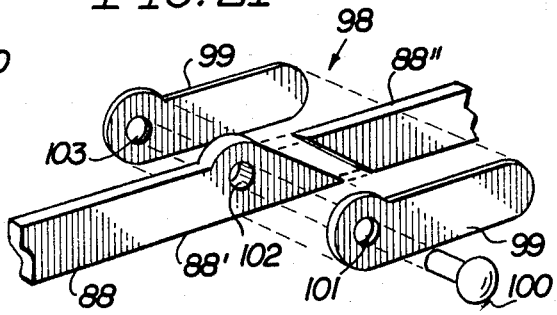
FIG. 23 is an isometric view in exploded form of a hinge structure associated with the embodiment of FIG. 19 and as indicated along line 23—23 of that Figure.

As best shown in FIG. 23, a hinge means generally indicated as 98 is provided and includes angularly oriented mating portions 88' and 88'' sandwiched between hinge links 99 on opposite sides thereof. A pivot pin 100 extends through correspondingly positioned and substantially aligned apertures 101, 102 and 103 formed in the links 99 and the portion 88' of the first auxiliary brace 88.

Figure 24:
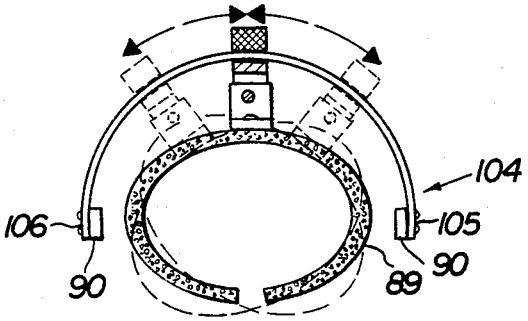
FIG. 24 is a sectional view along line 24—24 of FIG. 19.
Figure 26:
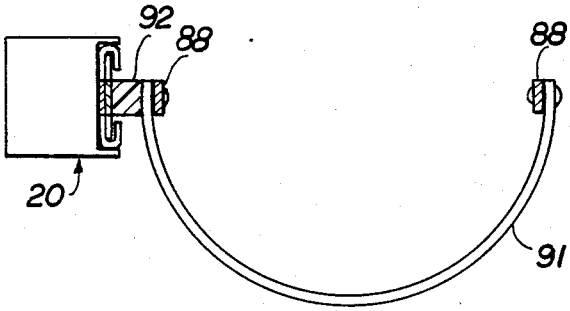
FIG. 26 is a sectional view along line 26—26 of FIG. 19.
Figure 25:
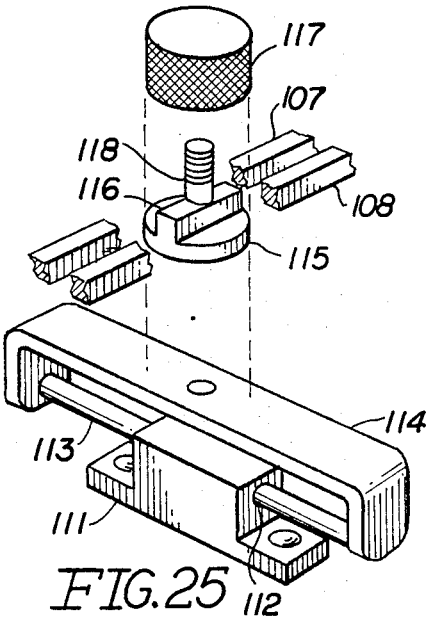
FIG. 25 is an isometric view in partially exploded form showing structural details of a coupling means associated with the second brace assembly of the embodiment of FIG. 19.
Figure 27:
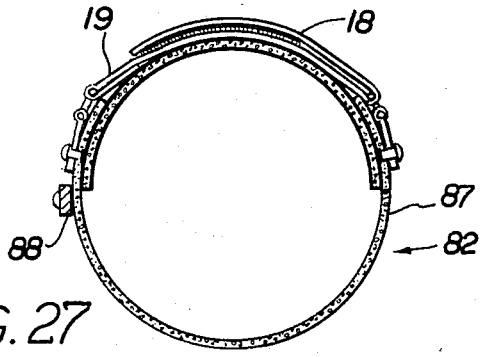
FIG. 27 is a sectional view along line 27—27 of FIG. 19.

With reference to FIGS. 24 and 25, a coupling means is provided which allows compound and relatively complex movement of the second brace assembly 84 and particularly the second primary brace 89 through both an allowed radial deviation and a preset radial position relative to the longitudinal axis of the forearm as the lower arm and hand move about the elbow joint 80 relative to the upper arm 83. A track means generally indicated as 104 is connected at its opposite ends 105 and 106 to the individual second auxiliary brace elements 90. This track means 104 includes individual track elements 107 and 108 (FIGS. 19 and 25) disposed in equally spaced apart and parallel relation to one another along the arcuately configured length of the track means 104. An anchor member 111 is fixedly attached to the palmar side of the hand and lower arm portion of the second primary brace 89 and includes a central channel 112 therein. A sliding finger or shaft 113 is designed to travel along its longitudinal axis through the channel 112 wherein the member 113 is fixedly secured to the mounting portio 114. This in turn is fixedly attached to a plug base 115 having an elongated plug element 116 secured thereto as shown in FIG. 25. The plug 116 is designed to travel between the individual track elements 107 and 108 but has a transverse dimension somewhat less than the spaced apart distance between track element 107 or 108. This smaller dimension allows a "skewing" effect or angular orientation of the plug relative to the longitudinal axis of both or either of the track elements 107 and 108 and this in turn allows a somewhat radial deviation of the second primary brace 89 which is fixedly interconnected to the anchor 111. Free movement between the elongated finger 113 within channel 112 of anchor element 111 compensates for the variation in longitudinal dimension as the lower arm 85 is moved from its totally outward extended position (FIG. 18) to its partially retracted or fully retracted position as represented in broken lines in FIG. 18. Also, a locking nut 117 is secured to an affixed screw threaded shaft 118 and when tightened serves to fixedly position the plug base along a predetermined point on the arcuate length of the track means 104. This has the effect of predetermining and maintaining a radial orientation of the lower arm 85 and hand 86 relative to the longitudinal axis of the forearm (see FIG. 24). Even when such locking nut 117 is secured in place, the aforementioned radial deviation or the angular skewing or orientation of the plug 116 between the track elements 107 and 108 may occur to compensate for the normal radial deviation of movement as the lower arm moves about the elbow joint 80 relative to the upper arm 83.

While the above three preferred embodiments are all specifically designed to provide passive exercising to a predetermined joint, FIG. 32 is directed towards the casing means 24 serving to house a gear assembly on the interior thereof and further serving to mount the drive motor 27 thereon. The housing generally indicated as 20 includes the aforementioned operating panel 21 positioned in exposed relation to an operator serving to activate and control the subject exercising device. A plurality of connector elements 120 serve to attach the housing 20 in overlying and completely enclosed relation to the exterior of the casing 24 as well as in covering relation to the drive motor 27 extending angularly out of one end of the casing means 24 as shown in FIG. 32. Further, the action arm means 35 extends outwardly from the casing and further passes through a specifically structured aperture 122 configured to adapt not only to the outward extension of action arm means 35 but also the reciprocal movement along the aforementioned predetermined path of travel thereof. As shown in FIG. 32, the casing means 24 with the drive means including drive motor 27 mounted thereon and being disposed in surrounded relation by said housing means 20 may represent a control housing assembly with the action arm 35 extending outwardly therefrom into driving interconnection with the second brace assembly.

Figure 42:
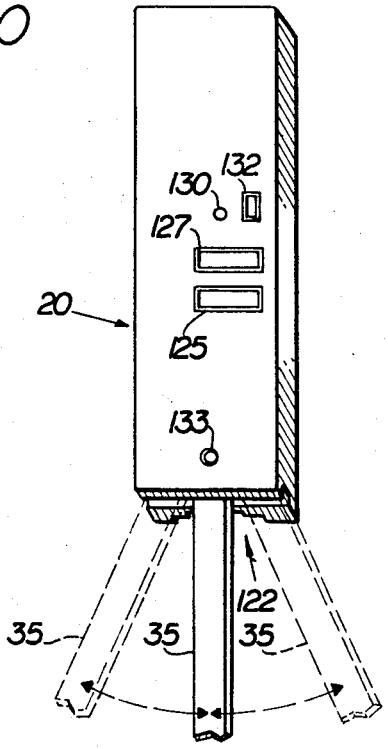
FIG. 42 is an isometric view of the housing means bearing extreme positions of the action arm as it travels along its predetermined path of travel.
Figure 43:
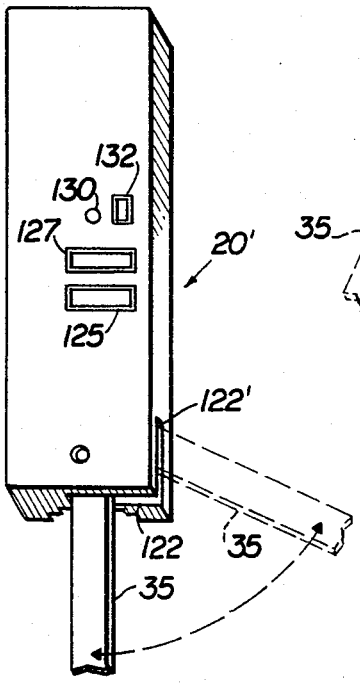
FIG. 43 is an isometric view of another embodiment of the present invention wherein the action arm is shown to extend out both an end and lateral portion of the housing means.
Figure 44:
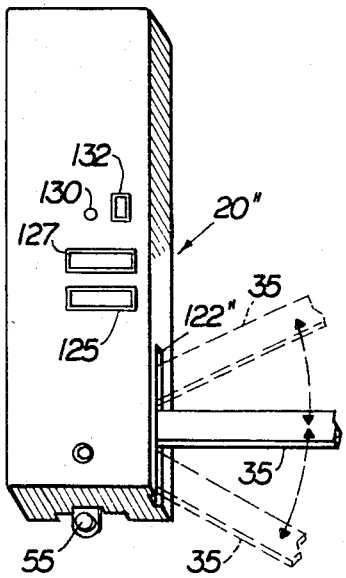
FIG. 44 is an isometric view representing another embodment of the present invention wherein the action arm extends out a lateral portion only of the housing means of the present invention.

With reference to FIGS. 42, 43 and 44 this aperture 122 (FIG. 42) may be formed in both a lateral side as at 122′ as well as an end of the housing 20° (FIG. 43) or totally from aperture 122″ formed in a lateral side only of housing means 20″ (FIG. 44). The various positions of the aperture 122, 122′ and 122″ accounts for the specific structural application of the various preferred embodiments as described above. Also as set forth above, the housing includes on its operating panel or exposed surface 21 a first access or indicator window 125 structured to provide visual access to a plurality of illumination devices each of which are associated with one of a plurality of switch elements comprising a switch assembly of the control circuitry as best shown in FIG. 45. A second access opening 127 is provided to physically position individual switch elements 129 (see FIG. 36) wherein each switch element is determinative of an extreme position of the action arm means 35 in terms of angular degrees as represented by the indicia 124 formed adjacent the individual illumination elements 123. As set forth above, these illumination elements can each be a conventional LED. An indicator opening or window 130 is provided for visual examination of an illumination means, also in the form of an LED indicating through activation of on/off switch 132 whether the device is operable. An auxiliary access opening window 133 is provided (see FIGS. 32 and 36) which allows visual examination of the indicator plate or wheel 39 and more specifically indicia 39′ thereon. Such indicia 39′ is indicative of the angular position of the action arm 35 relative to a standard dead center or normal position (indicated by zero degrees on indicator plate 39) wherein such indicia 39′ is viewable by an operator through the auxiliary window 133.

Figure 36:
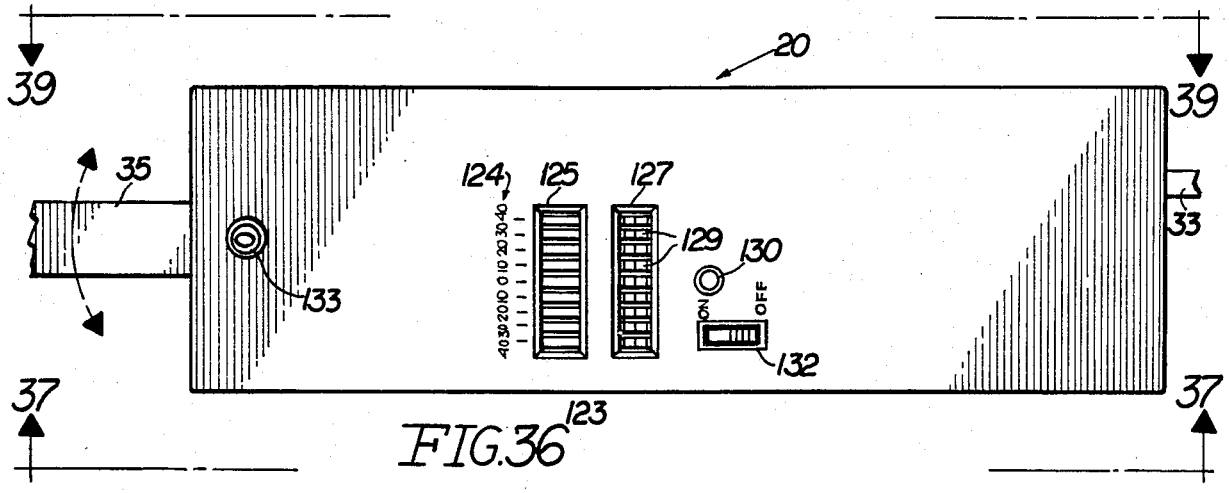
FIG. 36 is a top plan view of an exposed operating panel of a housing means.
Figure 37:
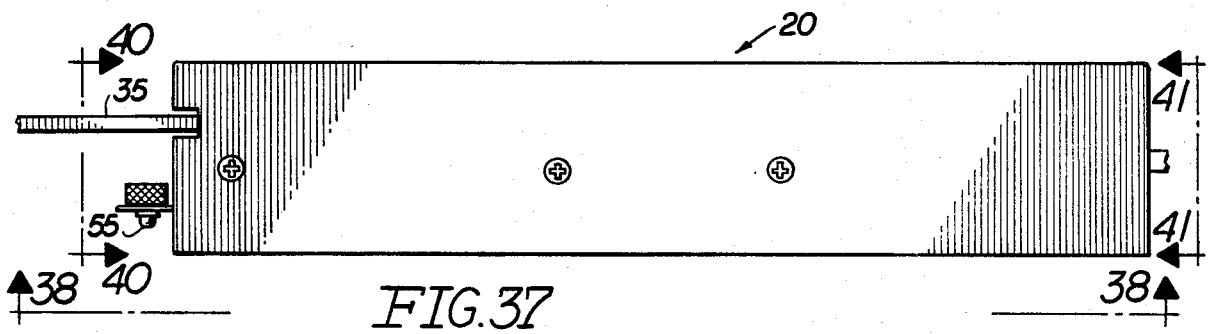
FIG. 37 is an end view along line 37—37 of FIG. 36.
Figure 38:
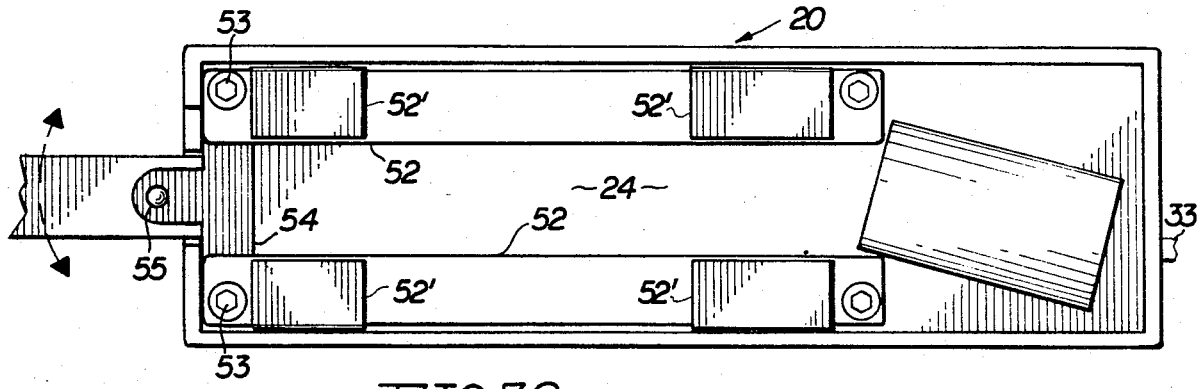
FIG. 38 is a bottom view along line 38—38 of FIG. 37.
Figure 39:
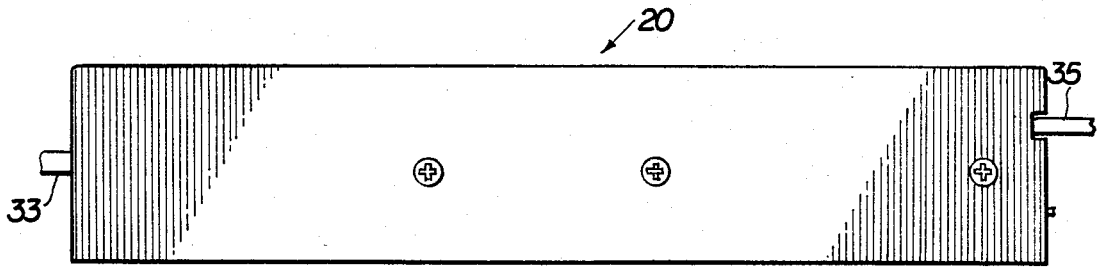
FIG. 39 is a side view along line 39—39 of FIG. 36.
Figure 40:
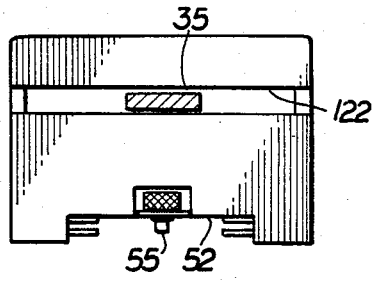
FIG. 40 is an end view in partial section along line 40—40 of FIG. 37.
Figure 41:
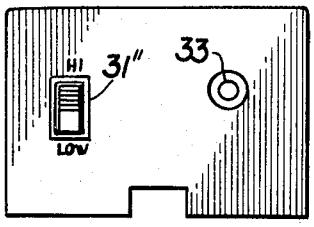
FIG. 41 is an opposite end view along line 41—41 of FIG. 37.

As shown in FIG. 45, the control means includes control circuitry wherein the circuitry schematically represented in FIG. 5 is representative only of the circuitry designed to accomplish the aforementioned movements of the limb portions relative to certain predetermined points of a patient's body. It should be emphasized however that other specific circuitry or microprocessor means may be involved to accomplish the same purpose. Basically, the circuitry is divided into a main printed circuit board assembly 150, a relay printed circuit sub assembly 151, and a sensor printed circuit sub assembly 152. The main printed circuit sub assembly includes the switching assembly 154 comprising a plurality of switch elements 159 interconnected in activating relation to a plurality of illumination devices 156 which may be light emitting diodes. This switching assembly 154 is electrically interconnected both to a sensor means generally indicated as 158 which is part of the sensor printed circuit assembly 152 and which is positioned to monitor the movement of the action arm means 35. In one embodiment, the sensor means 158 can be an optical or light sensitive sensor being interconnected to proper on/off gate means 159, along with the switching assembly 154 of the main printed circuit sub assembly 150 to the relay printed circuit sub assembly 151 which includes motor 27 and input power jack 33‴. Other features of the circuitry include on/off switch 160, operational indicator light 161, observable through opening 130 (FIG. 36) in operating panel 21. As set forth above, each of the light emitting diodes 156 is viewable through the window 125 and is associated with a specific one of the individual switch elements 129. The switch elements 129 are physically positionable and thereby activated by access through opening 127 in the operating panel 21 (FIG. 36).

It is therefore to be understood that the following claims are intended to cover all of the generic and specific features of the present invention herein described, and all statements of the scope of the invention which as a matter of language, might be said to fall therebetween.

Now that the invention has been described, what is claimed is:

1. A passive exercising device of the type designed to impart selective movement to a predetermined joint of a patient, said device comprising:

(a) brace means including at least a first and a second brace assembly each configured for securement to respective limbs of a patient's body adjacent to and on opposite sides of a predetermined joint thereof.

(b) drive means secured to said first brace assembly and including a drive motor and a gear assembly interconnected to said drive motor in driven relation thereto, (c) casing means structured for supporting both said drive motor and gear assembly in interconnected relation to one another and configured to support said drive means as a substantially contained unit and further structured for securing said contained unit on said first brace assembly and said respective limb portion so as to move therewith, (d) positioning means including an action arm means connected in driven relation to said drive means and extending therefrom into driving interconnection with said second brace assembly, (e) control means interconnected in activating relation to said drive motor and structured to regulate sequence and directional operation thereof, (f) said action arm means being structured to move in a path of travel substantially fixed relative to said casing means and disposed substantially parallel to a path of travel of the respective limb portions secured to said second brace assembly as it moves about the predetermined joint relative to the limb portions secured by said first brace assembly upon preselected activation and control of said drive motor by said control means, (g) said action arm comprising a substantially elongated configuration having one end interconnected in driven relation to said gear means, said action arm extending outwardly from said casing means a predetermined space distance into movable driving interconnection with said second brace assembly, (h) attachment means for securing said action arm means to said second brace assembly and being rotatably secured to said second brace asembly and structured to slidably move along a portion of the length of said action arm means adjacent a distal end thereof, (i) whereby selective movement of the predetermined joint is accomplished passively, independent of muscle control and actuation of the patient.

2. An exercising device as in claim 1 wherein said first and said second brace assembly are disposed in spaced relation to one another on opposite sides of the predetermined joint and are independently structured and configured to substantially correspond to the respective limb portions to which each is secured, said brace assembly being interconnected to one another at least by mounting of said casing means on said first brace assembly and movable interconnection of said action arm means to said second brace assembly.

3. An exercising device as in claim 2 wherein at least said second brace assembly is structured and configured for surrounding, grasping engagement of said respective limb portion, such that the latter respective limb portion is movable with said second brace assembly about the predetermined joint relative to said first brace assembly and its respective secured limb portion.

4. An exercising device as in claim 3 wherein each of said first and said second brace assemblies are structured and configured for surrounding, grasping engagement of respective limb portions for independent movement of the latter therewith, said exercising device securable to the patient to allow ambulatory movement of the patient.

5. An exercising device as in claim 1 wherein said action arm means comprises an elongated configuration and extends from said first brace assembly a predetermined spaced distance into driving interconnection with said second brace assembly, said action arm means having sufficient longitudinal dimension and being disposed for extension substantially across the predetermined joint, said action arm means movable relative thereto and upon activation of said drive means causing relative movement of one respective limb portion to one another about the predetermined joint.

6. An exercising device as in claim 1 wherein said drive motor comprises a power take-off shaft disposed in direct driving interconnection with one gear element of said gear assembly, said drive motor disposed and structured relative to said casing means and gear assembly to orient said power take-off shaft in substantially coplanar relation to said one gear element.

7. An exercising device as in claim 6 wherein said drive motor extends substantially linearly outwardly from one longitudinal end of said casing means and is drivingly interconnected to said gear assembly through said one gear element at a correspondingly positioned end of said gear assembly, said drive motor being oriented such that its longitudinal axis and said power take-off shaft are disposed in substantially parallel relation to a longitudinal axis of said gear assembly and said casing means.

8. An exercising device as in claim 7 wherein said power take-off shaft is disposed substantially colinear with a central longitudinal axis of said drive motor and at an angular and parallel relation to a central longitudinal axis of said casing means.

9. An exercising device as in claim 8 wherein said gear assembly comprises a drive shaft interconnected in driven relation through a plurality of gear elements defining a gear assembly to said drive motor and extending upwardly and outwardly from said casing means, said action arm means fixedly attached to said drive shaft so as to rotate therewith and disposed substantially perpendicular to a path of travel of said action arm means and a plane of interconnection defined by said one gear element and said power take-off shaft.

10. An exercising device as in claim 1 wherein said first brace assembly comprises a primary portion disposed and configured for mounting engagement with a lower leg portion of a patient and further including an auxiliary portion secured to said primary portion and extending outwardly therefrom into attached engagement with said second brace assembly, said primary portion disposed in adjacent and spaced relation to an ankle joint of the patient and said auxiliary portion extending substantially across a spaced distance between said primary portion and said second brace assembly and across the ankle joint.

11. An exercising device as in claim 10 wherein said second brace assembly is configured and structured in substantially gripping engagement with a foot portion of the patient and disposed in adjacent and at least partially spaced relation to said ankle; said casing means mounted on said first brace assembly and disposed in communicating relation with said second brace assembly through said action arm means, said action arm means extending from a driven interconnection with said drive means across a spaced distance between said first and said second brace assemblies into a driven interconnection with said second brace assembly, said action arm means cooperatively disposed and structured to cause a repeated sorsi flex and planter flex of the foot portion as said second brace assembly travels in a substantially predetermined arcuate path of travel upon actuation of said drive motor.

12. An exercising device as in claim 11 wherein said second brace assembly comprises a supporting platform means secured about the undersurface of the foot portion so as to move therewith; attachment means secured at least in part to said support platform and comprising an anchor element fixedly mounted on said platform, a head portion structured to slidably engage said action arm means and travel along a predetermined length thereof, link means fixedly secured to said ankle element and rotatably engaging said head portion; said action arm means and said attachment means cooperatively disposed and structured to cause repeated and predetermined sorsi and planter flexing of the foot portion about the ankle joint upon actuation of said drive motor.

13. An exercising device as in claim 12 further comprising adjustment means mounted on said second brace assembly and including a tongue element fixedly secured to said support platform, said adjustment means further including an orienting element affixed to said supporting platform in communicating attached relation to said tongue element and structured for securement therewith at a plurality of points along the length thereof, said tongue element and said orienting element structured and relatively disposed to define, when interconnected, a radial orientation of the foot portion within said second brace assembly relative to the central longitudinal axis of the lower leg portion engaged by said first brace assembly.

14. An exercising device as in claim 13 wherein said tongue element and said orienting element are both secured to an undersurface of said support platform, the latter having a substantially arcuate configuration along the length thereof and being transversely disposed relative to the former, a connector element structured and disposable to interconnect said tongue element at any one of a plurality of points along said arcuate length, whereby flexing of the foot portion about the wrist joint occurs at a predetermined radial angle relative to the longitudinally axis of the lower leg portion.

15. An exercising device as in claim 14 wherein said casing means is mounted laterally of said primary portion and said action arm means comprises an angularly offset configuration disposinq its distal end in engagement with said attachment means and in offset and parallel relation to its proximal end, said first brace assembly and attached casing means movable at least radially along said support platform through interconnection between said auxiliary portion and said anchor element, said action arm means constantly disposed to move in its path of travel being oriented substantially parallel to said casing means and the longitudinal axis of the lower front portion.

16. An exercising device as in claim 10 wherein said first brace assembly is configured at least in part to support and at least partially surround the calf of the lower leg portion and exteriorly configured for mounting on a leg support means, said leg support means comprising a multi-layered construction structured to support one lower leg portion and said first brace assembly thereof at a predetermined height in a substantially horizontal orientation.

17. An exercising device as in claim 16 wherein said leg support means comprises a cradle portion configured for placement of said first primary brace portion therein, a plurality of layers each removably secured to one other of said layers to define a stacked array, and connector strips mounted on exterior portions of said layers and on said first primary base portion for interconnection to one another.

18. An exercising device as in claim 1 further comprising a housing means structured and dimensioned for substantially surrounding engagement of said casing means including said drive motor and enclosing of said drive means and casing means as a self contained unit mounted on said first brace assembly so as to move therewith.

19. An exercising device as in claim 18 wherein said control means is maintained within said housing means and comprises a limit switch assembly electrically interconnected between said drive motor and a sensor means, said sensor means electrically interconnected to said drive motor and structured and disposed for maintaining of movement of said action arm means, movement of said action arm means limited along a path of travel between two preselected extremities, whereby movement of said first brace assembly and secured limb portion is regulated.

20. An exercising device as in claim 19 wherein said control means further comprises illumination means directly interconnected with said limit switch assembly, said housing means comprising an operating panel and a first access window formed thereon for visual inspection of said illumination means, whereby actuating of individual switch elements of said limit switch assembly is viewable through said first access window; a second access window disposed to provide physical access to said individual switch elements of said limit switch assembly, whereby movement of a limb portion about a predetermined joint is controllable from the exterior of said housing means adjacent said operating panel.

21. An exercising device as in claim 20 wherein said operating panel further comprises a third access window extending therethrough and disposed in visually observable relation to an indicator element and indicia thereon affixed directly to said action arm means, whereby actual positioning of said action arm means along said path of travel can be determined.

22. A control housing assembly as in claim 1 wherein said control means comprises sensor means structured for monitoring of position and movement of said action arm means and electrically interconnected to said drive motor, a limit switch assembly electrically interconnected between said drive motor and said sensor means and movement of said action arm means limited along a path of travel between preselected extremities determined by actuation of preselected switch elements of said limit switch assembly.

23. A control housing assembly as in claim 22 wherein said control means further comprises illumination means directly interconnected with said limit switch assembly, said housing means comprising an operating panel and a first access window formed thereon for visual inspection of said illumination means, whereby actuating of individual switch elements of said limit switch assembly is viewable through said first access window; a second access window disposed to provide physical access to said individual switch elements of said limit switch assembly, whereby movement of a limb portion about a predetermined joint is controlable from the exterior of said housing means adjacent said operating panel.

24. A control housing assembly as in claim 23 wherein said operating panel further comprises a third access window extending therethrough and disposed in visually observable relation to an indicator element and indicia thereon affixed directly to said action arm means, whereby actual positioning of said action arm means along said path of travel can be determined.

25. A passive exercising device of the type designed to impart selective movement to a predetermined joint of a patient, said device comprising:

(a) brace means including at least a first and a second brace assembly each configured for securement to respective limbs of a patient's body adjacent to and on opposite sides of a predetermined joint thereof (b) drive means secured to said first brace assembly and including a drive motor and a gear assembly interconnected to said drive motor in driven relation thereto, (c) casing means structured for supporting both said drive motor and gear assembly in interconnected relation to one another and configured to support said drive means as a substantially contained unit and further structured for securing said contained unit on said first brace assembly sand said respective limb portion so as to move therewith, (d) positioning means including an action arm means connected in driven relation to said drive means and extending therefrom into driving interconnection with said second brace assembly, (e) control means interconnected in activating relation to said drive motor and structured to regulate sequence and directional operation thereof (f) said action arm means configured to move in a path of travel substantially parallel to said casing means and further structured and cooperatively disposed relative to said drive means to cause substantially predetermined movement of said second brace assembly and its respective limb portion about the predetermined joint relative to said first brace assembly and its respective limb poriton upon preselected activation and control of said drive motor by said control means, whereby selective movement of the predetermined joint is accomplished passively, independent of muscle control and actuation by the patient.

(g) said drive motor comprising a power take-off shaft disposed in direct driving interconnection with one gear element of said gear assembly, said drive motor disposed and structured relative to said casing means and gear assembly to orient said power take-off shaft in substantially coplanar relation to said one gear element, (h) said drive motor extending substantially linearly outwardly from one longitudinal end of said casing means and being drivingly interconnected to said gear assembly through said one gear element at a correspondingly positioned end of said gear assembly, said drive motor being oriented such that its longitudinal axis is disposed in substantially parallel relation to a longitudinal axis of said gear assembly and said casing and said power take-off shaft is disposed substantially colinear with a central longitudinal axis of said drive motor and at an angular and parallel relation to a central longitudinal axis of said casing, (i) said gear assembly comprising a drive shaft interconnected in driven rotation through a plurality of gear elements defining a gear assembly to said drive motor and extending upwardly and outwardly from said casing means, said action arm means fixedly attached to said drive shaft so as to rotate therewith and disposed substantially perpendicular to a path of travel of said action arm means and a plane of interconnection defined by said one gear element and said power take-off shaft.

26. An exercising device as in claim 25 wherein said drive shaft, said gear assembly and said drive motor are collectively supported on said casing means and mounted on said first brace assembly substantially as a contained unit movable with said first brace assembly and respective limb portions to which it is secured.

27. A passive exercising device of the type designed to impart selective movement to a predetermined joint of a patient, said device comprising:

(a) brace means including at least a first and a second brace assembly each configured for securement to respective limbs of a patient's body adjacent to and on opposite sides of a predetermined joint thereof, (b) drive means secured to said first brace assembly and including a drive motor and a gear assembly interconnected to said drive motor in driven relation thereto, (c) casing means structured for supporting both said drive motor and gear assembly in interconnected relation to one another and configured to support said drive means as a substantially contained unit and further structured for securing said contained unit on said first brace assembly and said respective limb portion so as to move therewith, (d) positioning means including an action arm means connected in driven relation to said drive means and extending therefrom into driving interconnection with said second brace assembly, (e) control means interconnected in activating relation to said drive motor and structured to regulate sequence and directional operation thereof, (f) said first brace assembly comprising a primary portion disposed and configured for mounting engagement with a lower leg portion of a patient and further including an auxiliary portion secured to said primary portion and extending outwardly therefrom into attached engagement with said second brace assembly, said primary portion disposed in adjacent and spaced relation to an ankle joint of the patient and an auxiliary portion extending substantially across a spaced distance between said primary portion and said second brace assembly and across the ankle joint, (g) said second brace assembly being configured and structured in substantially gripping engagement with a foot portion of the patient and disposed in adjacent and at least partially spaced relation to said ankle; said casing means mounted on said first brace assembly and disposed in communicating relation with said second brace assembly through said action arm means, said action arm means extending from a driven interconnection with said drive means across a spaced distance between said first and said second brace assemblies into a driven interconnection with said second brace assembly, said action arm means cooperatively disposed and structured to cause a repeated sorsi flex and plantar flex of the foot portion as said brace assembly travels a substantially predetermined arcuate path of travel upon actuation of said drive motor, said second brace assembly comprising a supporting platform means secured about the undersurface of the foot portion so as to move therewith;

(h) attachment means secured at least in part to said support platform and comprising an anchor element fixedly mounted on said platform, a head portion structured to slidably engage said action arm means and travel along a predetermined length thereof, link means fixedly secured to said ankle element and rotatably engaging said head portion; said action arm means and said attachment means cooperatively disposed and structured to cause repeated and predetermined sorsi and plantar flexing of the foot portion about the ankle joint upon actuation of said drive motor, (i) said action arm means configured to move in a path of travel substantially parallel to said casing means and further structured and cooperatively disposed relative to said drive means to cause substantially predetermined movement of said second brace assembly and its respective limb portion about the predetermined joint relative to said first bracing assembly and its respective limb portion upon preselected activation and control of said drive motor by said control means, whereby selective movement of the predetermined joint is accomplished passively, independent of muscle control and actuation by the patient.

* * * * *